US009664490B2

(12) United States Patent
Ohlson

(10) Patent No.: US 9,664,490 B2
(45) Date of Patent: May 30, 2017

(54) LOADING ARRANGEMENT FOR A DESTRUCTION SYSTEM

(71) Applicant: DYNASAFE DEMIL SYSTEMS AB, Karlskoga (SE)

(72) Inventor: Fredrik Ohlson, Torslanda (SE)

(73) Assignee: DYNASAFE DEMIL SYSTEMS AB, Karlskoga (SE)

( * ) Notice: Subject to any disclaimer, the term of this patent is extended or adjusted under 35 U.S.C. 154(b) by 0 days.

(21) Appl. No.: 15/109,178

(22) PCT Filed: Feb. 5, 2015

(86) PCT No.: PCT/EP2015/052404

§ 371 (c)(1),
(2) Date: Jun. 30, 2016

(87) PCT Pub. No.: WO2015/124436

PCT Pub. Date: Aug. 27, 2015

(65) Prior Publication Data

US 2016/0327381 A1 Nov. 10, 2016

(30) Foreign Application Priority Data

Feb. 21, 2014 (EP) ..... 14156089

(51) Int. Cl.
*F42B 33/06* (2006.01)
*F42D 5/04* (2006.01)
(Continued)

(52) U.S. Cl.
CPC ..... *F42B 33/067* (2013.01); *F23G 5/10* (2013.01); *F23G 5/40* (2013.01); *F23G 5/448* (2013.01);
(Continued)

(58) Field of Classification Search
CPC . F42D 5/04; F42D 5/00; F42B 33/067; F23G 7/00; F23G 5/444; F23G 5/50; F23G 2209/16
See application file for complete search history.

(56) References Cited

U.S. PATENT DOCUMENTS 3,772,958 A * 11/1973 Mullarkey ..... F42B 33/067 102/293
4,389,947 A * 6/1983 King ..... F42D 5/045 109/1 S
(Continued)

FOREIGN PATENT DOCUMENTS

CN 203518865 4/2014
WO 20140191278 4/2014

OTHER PUBLICATIONS

Erik Van Leeuwen, Written Opinion of International Search Authority, parent International Application serial No. PCT/EP2015/0522404, Apr. 2, 2015, European Patent Office, Rijswijk, Netherlands.

*Primary Examiner* — Benjamin P Lee
(74) *Attorney, Agent, or Firm* — Babcock IP, PLLC

(57) ABSTRACT

The present invention relates to a loading arrangement for a destruction system configured for destruction of ammunition, small arms and thereto related material, and provides the advantage of improved safety surrounding loading of munitions into a chamber of the destruction system. The loading arrangement comprises a transportation duct at an inclined angle. A cradle configured to receive the munitions is pivotably attached to the transportation duct and can be pivoted upwards into the transportation duct through a cradle opening. A closure plate mechanically linked to the cradle and adapted to close the cradle opening is automatically moved as the cradle pivots upwards so as to open the cradle opening. The transportation duct can be releasably
(Continued)

connected to an input duct of the chamber of the destruction system.

14 Claims, 6 Drawing Sheets

(51) Int. Cl.
*F23G 5/10* (2006.01)
*F23G 5/40* (2006.01)
*F23G 5/44* (2006.01)
*F23G 7/00* (2006.01)

(52) U.S. Cl.
CPC ..... *F42D 5/04* (2013.01); *F23G 7/003* (2013.01); *F23G 2203/601* (2013.01); *F23G 2209/16* (2013.01)

(56) References Cited

U.S. PATENT DOCUMENTS 4,551,051 A 11/1985 Hofbauer
4,930,965 A * 6/1990 Peterson ..... C04B 7/4438 110/180
5,078,594 A 1/1992 Tuit
5,224,433 A * 7/1993 Benoit ..... C04B 7/4407 110/226
5,495,812 A * 3/1996 Schulze ..... F23G 5/00 110/237
5,613,453 A * 3/1997 Donovan ..... F42B 33/06 110/237
5,727,481 A * 3/1998 Voorhees ..... F23G 5/40 110/193
5,806,442 A * 9/1998 Aldred ..... C04B 7/443 110/118
5,884,569 A * 3/1999 Donovan ..... F23G 7/003 110/237
6,173,662 B1 * 1/2001 Donovan ..... F42B 33/06 110/193
6,234,091 B1 * 5/2001 Largent ..... C04B 7/443 110/101 C
6,354,181 B1 * 3/2002 Donovan ..... F42D 5/045 110/237
6,676,407 B2 * 1/2004 Largent ..... F23G 5/444 432/103
7,073,424 B2 * 7/2006 Ferrari ..... F42B 33/06 86/50
7,700,047 B2 * 4/2010 Quimby ..... F42B 33/067 110/235
7,819,046 B2 * 10/2010 Ohlson ..... F42B 33/06 86/50
8,006,600 B2 * 8/2011 Fujiwara ..... F42B 33/067 110/237
9,417,043 B2 * 8/2016 Ohlson ..... F23G 5/444
2003/0050524 A1 * 3/2003 Northcutt ..... F23G 7/003 588/320
2005/0150369 A1 * 7/2005 Lacombe ..... F42D 5/045 86/50
2016/0054110 A1 * 2/2016 Ohlson ..... F23G 5/444 86/50

* cited by examiner

LOADING ARRANGEMENT FOR A DESTRUCTION SYSTEM

TECHNICAL FIELD

The present invention relates to a loading arrangement for a destruction system configured for destruction of ammunition, small arms and thereto related material.

BACKGROUND OF THE INVENTION

A destruction system may be used for destroying explosive objects such as e.g. ammunition, propellants or explosives, including for example old unusable or unwanted ammunition. Such a system must be robust in order to withstand the high loads of possible detonating explosives.

An example of such a destruction system is disclosed in EP0898693 where munitions are loaded in a destruction chamber through a combined inlet/outlet. The chamber is emptied after use by rotating the chamber through 180°. A similar system is disclosed in WO96/12157.

Further attention is drawn to U.S. Pat. No. 4,551,051, disclosing a rotary kiln that is charged with pneumatic tires by a lock chamber which carries two gates adapted to be opened in alternation. To ensure a desirable charging operation, the lock chamber provides a runway downwardly inclined towards the kiln inlet and having a length which is at least twice the tire diameter. The gate at the receiving end of the lock chamber is provided with a tire holder for holding each tire in a position for rolling on the runway. The tire holder comprises a gripping device having two gripping jaws operable to move in mutually opposite directions and engageable with the side wall of a pneumatic tire. The gripping jaws are mounted to be adjustable in a direction parallel to the runway and transversely to the direction of travel of the tire on the runway.

Loading of munitions into the destruction chamber is an important part of the destruction process and it is thus desirable to enable a user-friendly and safe way to do it. Even though the above mentioned prior art shows very useful solutions for loading and unloading of objects, it would still be desirable to even further optimize such a destruction system with a dedicated loading arrangement.

SUMMARY OF THE INVENTION

In view of the above mentioned need, a general object of the present invention is to provide an improved loading arrangement for a destruction system which at least to some extent provides further improvements in relation to prior art.

According to an aspect of the invention, there is provided a loading arrangement for a destruction system, the destruction system comprising at least one of a kiln or a detonation chamber configured for destruction of munitions, wherein the loading arrangement comprises an elongated transportation duct at one end comprising an open engagement portion adapted to provide a connection to an input duct of the at least one of the kiln or the detonation chamber, a cradle being hinged to the transportation duct at a cradle opening of the elongated transportation duct, and a fragment valve connected to the cradle, wherein the elongated transportation duct is arranged at a positive angle in relation to a horizontal plane, the cradle in a first position is configured to receive the munitions, the cradle in a second position is at least partly inserted into the elongated transportation duct through the cradle opening allowing the munition to slide into the at least one of the kiln or the detonation chamber, and the cradle in the first position is configured to adjust a position of the fragment valve for closing the cradle opening of the transportation duct.

In accordance with the present invention, munitions may for example include small and medium sized ammunitions, grenades or the like, and/or propellants such as fuel, gasoline, oxidizer, rocket fuel, jet fuel etc., and/or any type of explosive object. Other types of similar objects may of course be included within the scope of the invention. Furthermore, a kiln or a detonation chamber is here understood to include chamber, possibly being thermally insulated, that may be configured to withstand a powerful detonation of munitions and may comprise for example a steel element for creating a robust wall. In regards to a kiln, the kiln is preferably configured to produce a sufficient temperature for destruction of munitions or similar, preferably configured to operate at temperatures around e.g. 350° C. or higher. In the further description of the invention, the general expression "chamber" will be used for indication both a kiln and a destruction chamber. In addition, please note, the expressions "destruction chamber" and "detonation chamber" will be user interchanged throughout the description.

Advantages with the invention includes for example an improved safety situation surrounding the process of loading of munitions into the kiln/detonation chamber, specifically provided by, once loading of munitions is completed, positioning the cradle away from the input duct of the kiln/detonation chamber and covered by the fragment valve, through which possible debris in case of an explosion (possibly unwanted) may find its way. The advantages are typically achieved by the provision of an elongated transportation duct configured to connect to an input duct of the above discussed chamber, where the long side of the elongated transportation duct is provided with an opening for receiving a cradle, the cradle provided for receiving and holding the munitions during the loading process.

For the sake of understanding, the open engagement portion of the elongated transportation duct will accordingly connect to the input duct of the kiln, where the open engagement portion preferably is positioned at a short side of the elongated transportation duct. The opposite short side of the elongated transportation duct may be closed or connected to another loading system.

The elongated transportation duct is such arranged that it is positively angled in relation to the chamber, thereby allowing the munitions to "slide" into the chamber. As such, when arranging the elongated transportation duct at a positive angle in relation to the chamber, the opening for receiving the cradle is preferably arranged at a lower long side of the elongated transportation duct, allowing the cradle to be inserted "from the bottom" of the duct. By connecting the cradle to the elongated transportation duct, by means of a hinge arranged in the direction of the elongated transportation duct facing the input duct of the chamber, the cradle may be positioned in an essentially horizontal direction once the cradle is receiving the munitions and then being "tilted" into the elongated transportation duct such that the munitions slides into the camber through its input duct.

For providing a further increase security, a fragment valve is provided with the loading arrangement for closing the opening in the elongated transportation duct when the cradle is in the first position. The fragment valve as well as the elongated transportation duct may for example be made from steel or similar for withstanding the possible detonation of explosives inside the chamber. Furthermore, the fragment valve may in some implementations be arranged to provided an essentially gas tight seal in regards to the elongated transportation duct, thereby possibly making the complete destruction system airtight (possibly necessary in relation to some type of munitions).

In an embodiment of the invention, the fragment valve is configured to be shifted in an essentially parallel path in relation to a direction of the elongated transportation duct when transitioning from the first to the second position. This may possibly improve and simplify the construction and durability of the loading mechanism.

In a preferred embodiment, the open engagement portion of the elongated transportation duct is configured to be releasably connected to the input duct of the at least one of the kiln or the detonation chamber. Advantages with such an implementation may allow the inventive loading mechanism to be used in relation to some types of chambers where the process of unloading waste material resulting from destructed munitions may involve changing position to the chamber. In such an embodiment, the loading arrangement may possibly further comprising locking means for securely connecting the loading arrangement to the at least one of the kiln or the detonation chamber. Such locking means may for example include a releasable clamp, the clamp configured to engage with a flange provided at the outer end of the input duct of the at least one of the kiln or the detonation chamber. It should however be understood that any type of suitable looking means may be provided for achieving the desired effect of securely connecting the open engagement portion of the elongated transportation duct to the input duct.

In case of a releasable connection between the loading arrangement and the chamber, the loading arrangement may be provided with a spring suspension for allowing the loading arrangement to change between a connected position and a disconnected position in relation to the input duct of the chamber. The spring suspension mechanism may additionally allow for coping with a temperature expansion of the chamber taking place during the destruction process, specifically applicable in relation to using a kiln for destruction of the munitions.

Preferably, the loading arrangement further comprises actuators arranged to transition the cradle from the first to the second position. Accordingly, using actuators for controlling the cradle position, the loading may be automated, possibly allowing the actual transition between the first and the second cradle position to take place only once operations personal has been position at a safe location away from the destruction system.

The actuators may be telescoping arms but for the cradle tilting it may also be possible to use a slew drive. The telescoping arms may be arranged such that in a compressed state, the cradle is tilted into the elongated transportation duct, i.e. the second position for the cradle. Conversely, when the telescoping arms are in an extended state, the cradle is arranged in the first position for receiving munitions. The use of telescoping arms are advantageous because they are robust, easily mounted and controlled, and quickly replaced.

As indicated above, the loading mechanism is preferably provided as an element of a complete destruction system, further comprising the at least one of a kiln or a detonation chamber configured for destruction of munitions, the at least one of a kiln or a detonation chamber comprising an input duct, where the above discussed loading arrangement is connected to the input duct of the at least one of a kiln or a detonation chamber.

In an embodiment, the kiln is arranged to comprise an electrical heating element for heating the munitions such that it is destroyed. Heating by means of an electrical heating element has advantages in relation to an open fire, relating both the increased control of the destruction process as well as in relation to safety of the operating personnel.

In a preferred embodiment, the chamber is a kiln and the kiln is configured to be rotatable about a horizontal axis between a first loading and operating position, and in a second emptying position, where the kiln when arranged in the first loading and operating position is configured to releasably connect to the loading arrangement, possibly but not limited to the manner as discussed above using a spring suspension mechanism. Also, it is preferred to arrange the input duct at an upper portion of kiln and the electrical heating element is arranged at a lower portion of the kiln, when the kiln is arranged in the first loading an operating position.

In an embodiment, the kiln is rotated about the horizontal axis from the first position to the second position in a direction such that the duct travels past a vertical axis of the kiln, a rotating angle being at least 120°. In other words, the kiln is configured to be rotated in a direction such that the input duct travels directly above a center point of the kiln that coincides with the horizontal axis of the kiln. This is advantageous because it allows a more efficient extraction of waste material from inside the kiln because the waste naturally falls into the duct this way. In an implementation of the invention, the kiln may be "shaken" for facilitating emptying of the loading tray when the kiln is in a loading position and the gate is open. This may be performed by small repetitive rotations about the horizontal axis of the kiln.

A motor is advantageously provided for rotating the kiln between the first and second "emptying" position. This is advantageous because it simplifies the use of the system. The motor is advantageously an electric motor, but any other types of motors work equally well.

The kiln advantageously comprises a cylindrical shape. A cylindrical shape may facilitate the construction of the kiln. It further facilitates arranging the input duct in the kiln since the curvature of the kiln may then only be along one circumference where the kiln is arranged. The cylindrical shape may be a circumference around an outside of the kiln in the direction of a rotation of the kiln about the horizontal axis. However, the kiln may further comprise other shapes such as a spherical, a cubic or any other suitable shape.

The destruction system is advantageously arranged on a trailer for allowing mobility of the destruction system. This way, fast and simple relocation of the destruction system is enabled. It is further advantageous because a trailer may be towed by a standard vehicle, such as e.g. a truck. The destruction system may also be arranged inside of a standard sized container. Accordingly, the destruction system is preferably dimensioned for allowing the discussed mobility (e.g. trailer) or for allowing fitting within a standard sized container.

As a possible alternative to providing a rotatable chamber, the at least one of a kiln or a detonation chamber may be arranged in a static upright position, the at least one of a kiln or a detonation chamber having the input duct arranged at its upper portion and further comprising an output duct arranged at its lower portion. Such an implementation may be preferred, specifically in relation to an, in comparison, larger chamber, having a size making it unsuitable for rotation for example due to its inherent weight.

The destruction system may advantageously comprise a control unit configured for controlling the actuators of the loading arrangement as well as for possibly controlling the rotation of the chamber. This is advantageous because it allows automatic and/or remote control of the destruction system. Accordingly, operation of the system may be at least partly automated, implemented as e.g. software, hardware and a combination thereof.

The control unit is preferably a micro processor or any other type of computing device. Similarly, a software executed by the control unit for operating the inventive system may be stored on a computer readable medium, being any type of memory device, including one of a removable nonvolatile random access memory, a hard disk drive, a floppy disk, a CD-ROM, a DVD-ROM, a USB memory, an SD memory card, or a similar computer readable medium known in the art.

According to an embodiment, the destruction system additionally comprises a camera for monitoring an amount of waste material in the chamber. This is advantageous because it allows determining if the chamber is full or if it needs to be emptied.

Further features of, and advantages with, the present invention will become apparent when studying the appended claims and the following description. The skilled addressee realize that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawings, in which.

DETAILED DESCRIPTION

Figure 1:
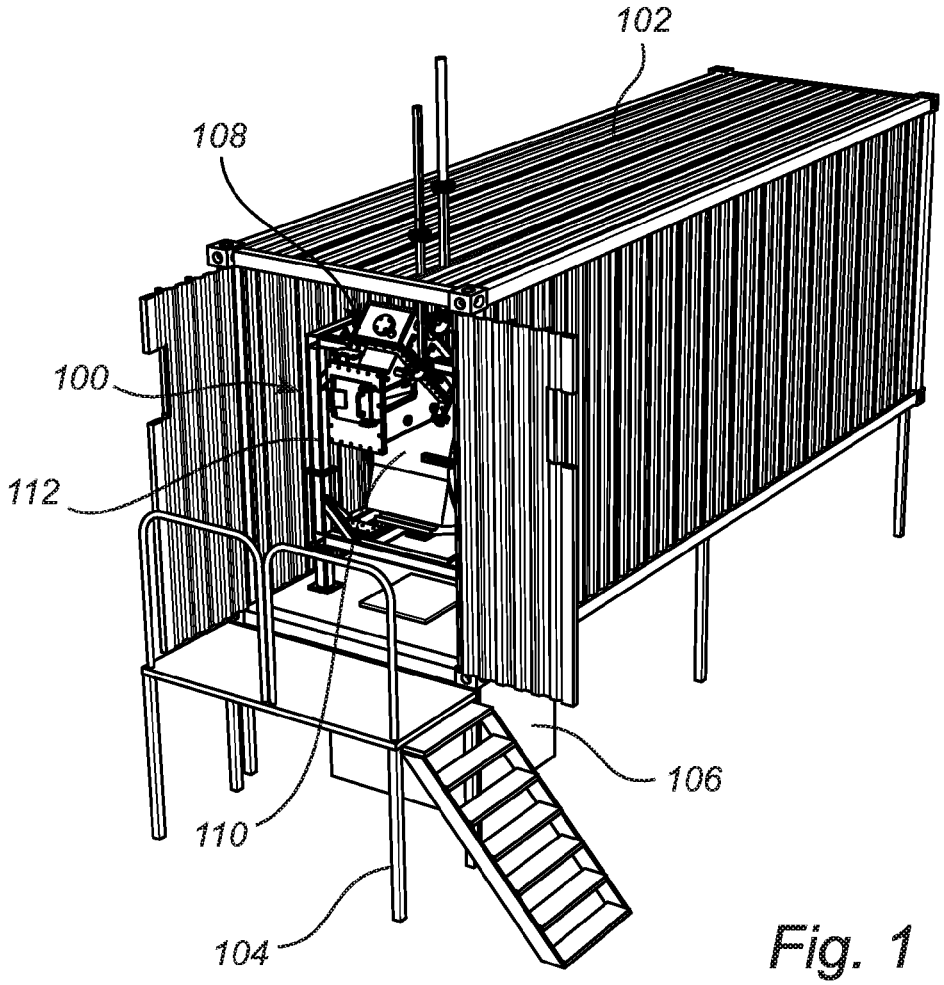
FIG. 1 illustrates a perspective partly cross section view of a destruction system arranged in a container.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Referring now to the drawings and to FIG. 1 in particular, there is depicted a destruction system 100 arranged inside of a container 102, preferably of a standard size such as for example a 10 feet container. In FIG. 1 the container 102 is arranged in an elevated position in relation to a ground level by means of a plurality of adjustable pillars 104. A waste bin 106 is arranged below the elevated container 102, the waste bin 106 positioned to receive waste material resulting from munitions destructed by the destruction system 100.

The destruction system 100 further comprises a loading arrangement 108 and a destruction chamber, in the illustrated embodiment being a rotating kiln 110. A stand 112 is further provided for supporting the loading arrangement 108 and the kiln 110. The stand 112 is in this embodiment configured for allowing rotation of the kiln 110.

Figure 2:
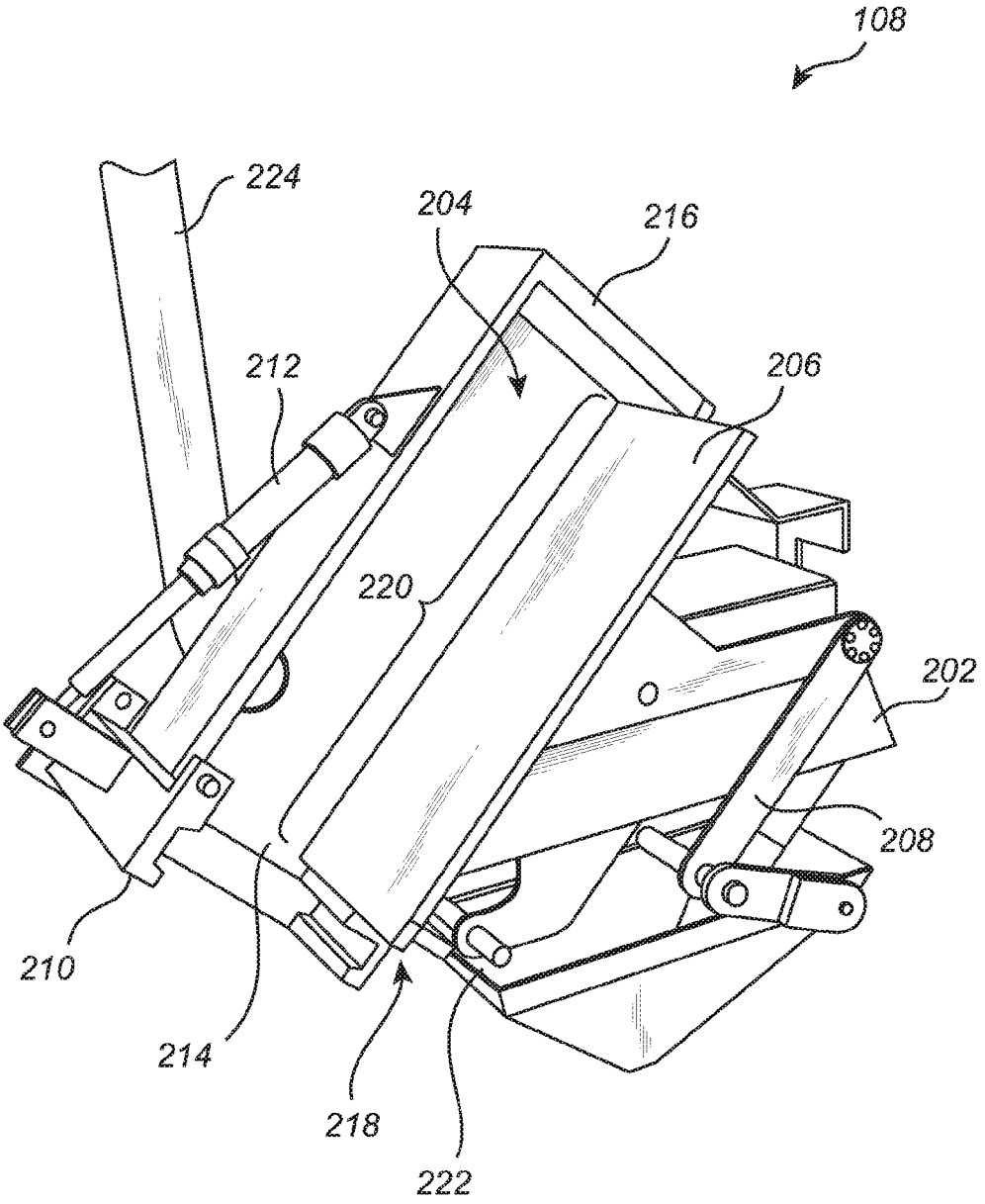
FIG. 2 shows a detailed cross section view of a loading arrangement according to a currently preferred embodiment of the invention.

With reference to FIG. 2 there is provided a detailed cross section view of a loading arrangement 108. As may be seen from FIG. 2, the loading arrangement 108 comprises a cradle 202, an elongated transportation duct 204 and a fragment valve 206 connected to the cradle 202 by means mechanical linking elements 208. The loading arrangement further comprises a safety device in the form of a safety clamp 210, the clamp 210 being controlled by compressing/decompressing an actuator 212 at one end connecting to the clamp 210 and at the other end, for example, connected to the elongated transportation duct 204. The clamp 210 is configured to engage and securely lock to, for example, a flange of the above discussed rotatable kiln 110. The connection between the kiln 110 and the loading arrangement 108 which will be further discussed below in relation to FIGS. 4*a*-4*d*.

The elongated transportation duct 204 is in one of its short ends provided with an open engagement portion 214 for the purpose of connecting with the kiln 110, typically to an input duct of the kiln 110. The opposite short side end 216 of the elongated transportation duct 204 is typically closed. At a lower long side 218 of the elongated transportation duct 204 there is provided a cradle opening 220 for allowing the introduction of the cradle 202. For allowing the cradle 202 to be introduced into the elongated transportation duct 204, the cradle 202 is provided with some type of hinge means 222 thereby making it possible for the cradle 202 to be tilted into the elongated transportation duct 204. The loading arrangement 108 may additionally, as is shown in FIG. 2, be provided with an exhaust pipe 224.

The functionality and mechanical linkage of the loading arrangement 108 explained in more detail in relation to FIGS. 3A-3D. Specifically, in FIG. 3A the cradle 202 is positioned in a first position where the cradle 202 is configured to receive the munitions to be destroyed, hence the clamp 210 is in its closed position. The munitions may for example be provided in a feeding box (not specifically shown) having a size suitable for reception by the cradle 108.

In the first position, the linking elements 208 connecting the cradle 202 to the fragment valve 206 forces the fragment valve 206 to securely lock against a flange of the cradle opening 220. Depending on the type of implementation, it may be possible to configure the lock between the flange of the cradle opening 220 and the fragment valve 206 to be gas tight, however not being a necessity.

Figure 3A:
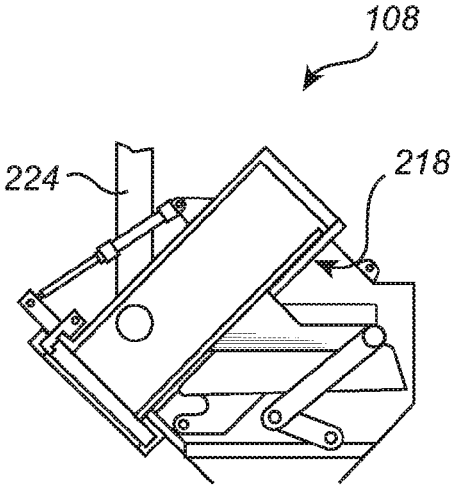
FIG. 3A-3D illustrates the loading arrangement of FIG. 2, where the cradle is transitioning from a first to a second position.
Figure 3B:
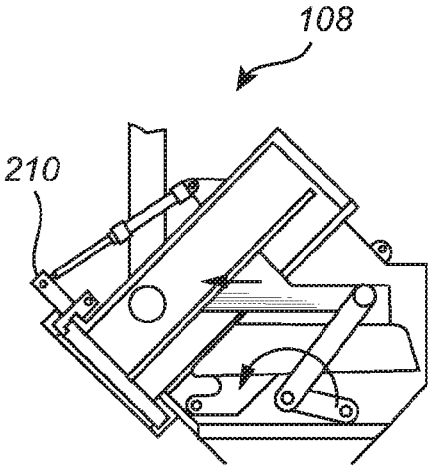
Figure 3C:
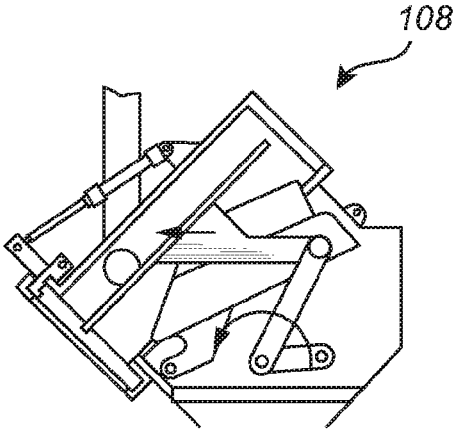

With further reference to FIGS. 3A and 3B, in transitioning the cradle 202 from its first position to its second position (the second position will be discussed below in relation to FIG. 3D), the linking elements 208 will be forced to change position, typically using one or a plurality of actuators, whereby the cradle 202 will start to tilt towards the inside of the elongated transportation duct 204, fixed at an axis defined by the hinge means 222. As the cradle 202 is moving inside of the elongated transportation duct 204, the linking elements 208 connecting the cradle 202 and the fragment valve 206 will also make the fragment valve 206 move inside of the elongated transportation duct 204, thereby shifting the fragment valve 206 in an essentially parallel path in relation to a direction of the elongated transportation duct 204.

Figure 3D:
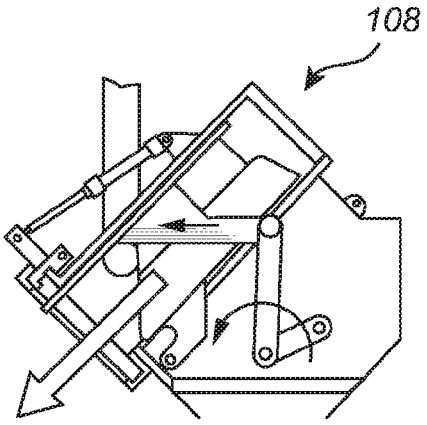

Once the cradle 202 has fully transition from the first to the second position, with further reference to FIG. 3D, the cradle 202 will be fully inserted inside of the elongated transportation duct 204, positively angled in essentially the same angle as the elongated transportation duct 204, whereby the munitions, possibly provided in the feeding box, will slide through the input duct and inside of the kiln. When the cradle 202 is arranged at its second position, the fragment valve 206 will be pushed towards the long side of the elongated transportation duct 204 facing the cradle opening 220.

Referring now to FIG. 4A-4D, relating to the operation of the inventive destruction system, in the illustrated embodiment comprising a rotating kiln 110. The rotating kiln 110 comprises an input duct 402 having the above discussed flange 404, the input duct 402 extending from the outside to an inside of the kiln 110. A heating element 406 is located in an insulated section of the kiln 110 on a side essentially opposite from the input duct 402. The heating element 406 is used for providing sufficient heat to munitions or explosives placed in the compartment such that the munitions or explosives are thermally destructed.

Figure 4B:
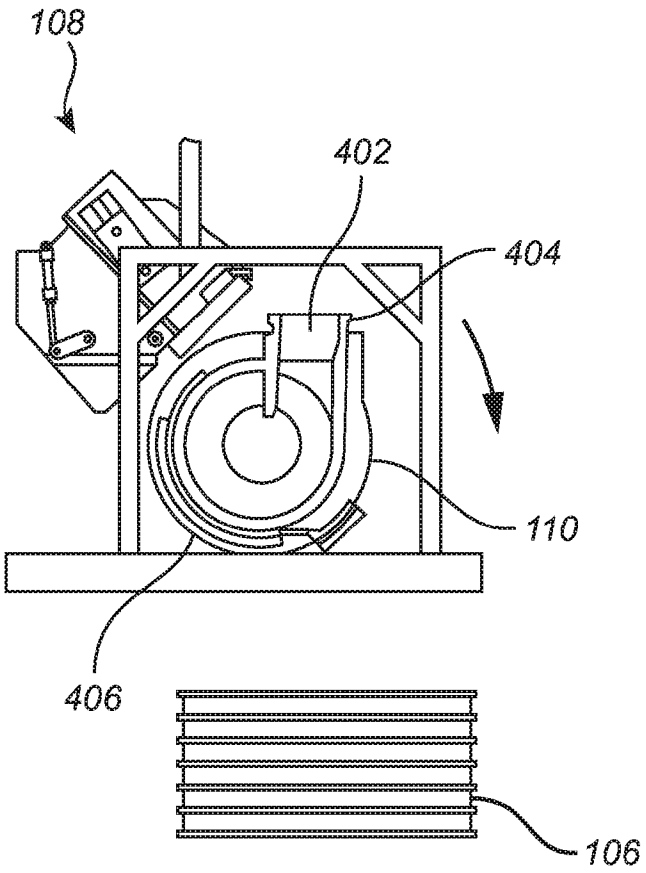
FIG. 4A-4D sequentially illustrates the process of discharging waste material from a destruction system comprising a rotating kiln, and FIG. 5 conceptually illustrates a destruction system comprising a loading arrangement and a chamber arranged in a static upright position.
Figure 4A:
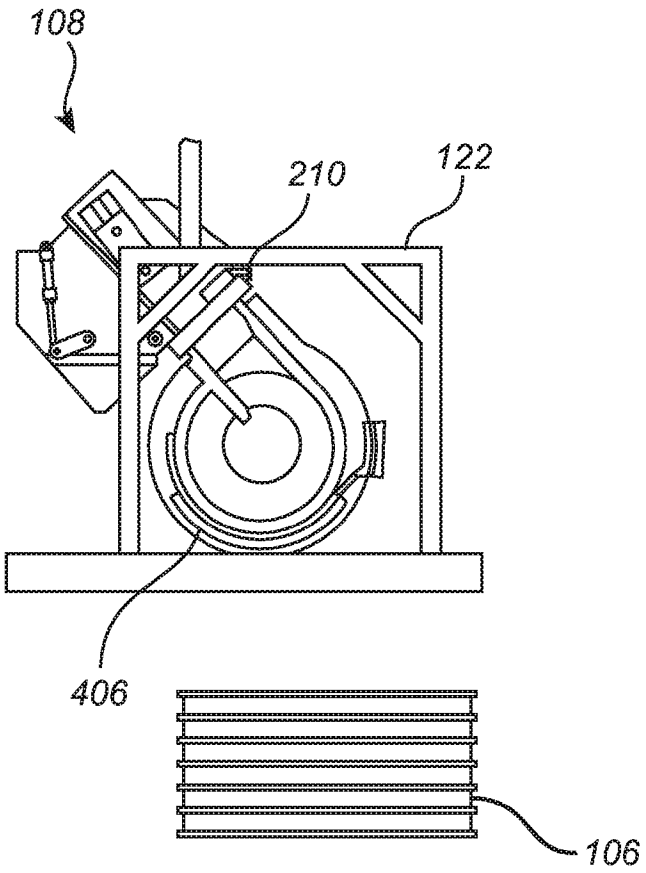
Figure 4D:
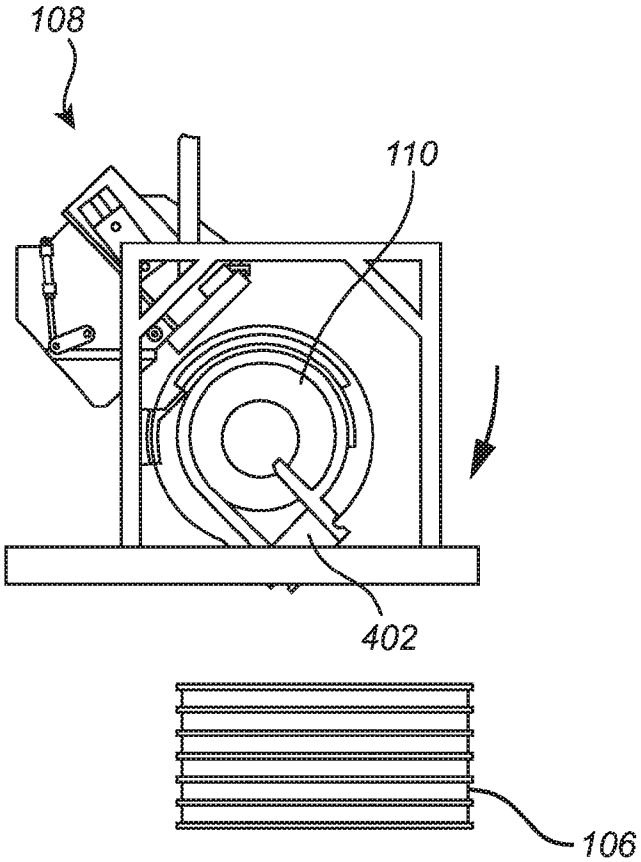
Figure 4C:
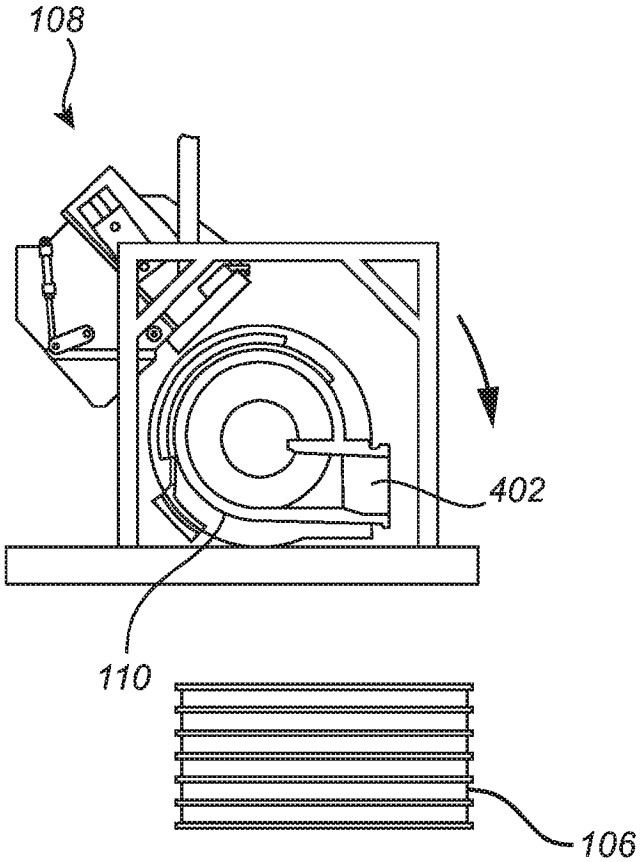

The process starts in FIG. 4A, shown with the clamp 210 in the disengaged position, thus making it possible for the kiln 110 to be released from the loading arrangement 108. The kiln 110 will be controlled, e.g. using the above discussed control motor, to rotate "away" from the loading arrangement 108, as sequentially illustrated in FIGS. 4B and 4C, eventually reaching an "end position" as illustrated in FIG. 4D, where the inlet duct 402 of the kiln will be positioned essentially above the waste bin 106. The kiln 110 may in the end position be "shaken" for facilitating emptying of any waste material inside of the kiln 110. The process of shaking the kiln 110 may be performed by small repetitive rotations about a horizontal axis of the kiln 110. After the kiln 110 is emptied, the kiln 110 may again be rotated back in the opposite direction for again connecting to the loading arrangement 108, including securely locking the clamp 210 to the flange 404. As understood from the above, the input duct 402 will accordingly also be used for emptying waste material out of the kiln 110.

Several destruction processes may be performed before the kiln 110 needs to be unloaded. This is determined by an amount of waste material, such as e.g. metal pieces that is accumulated in the kiln 110. The amount of waste material may be determined by e.g. a camera suitably mounted allowing an operator to see the inside of the kiln 110 for determining the amount of waste material currently being present.

Figure 5:
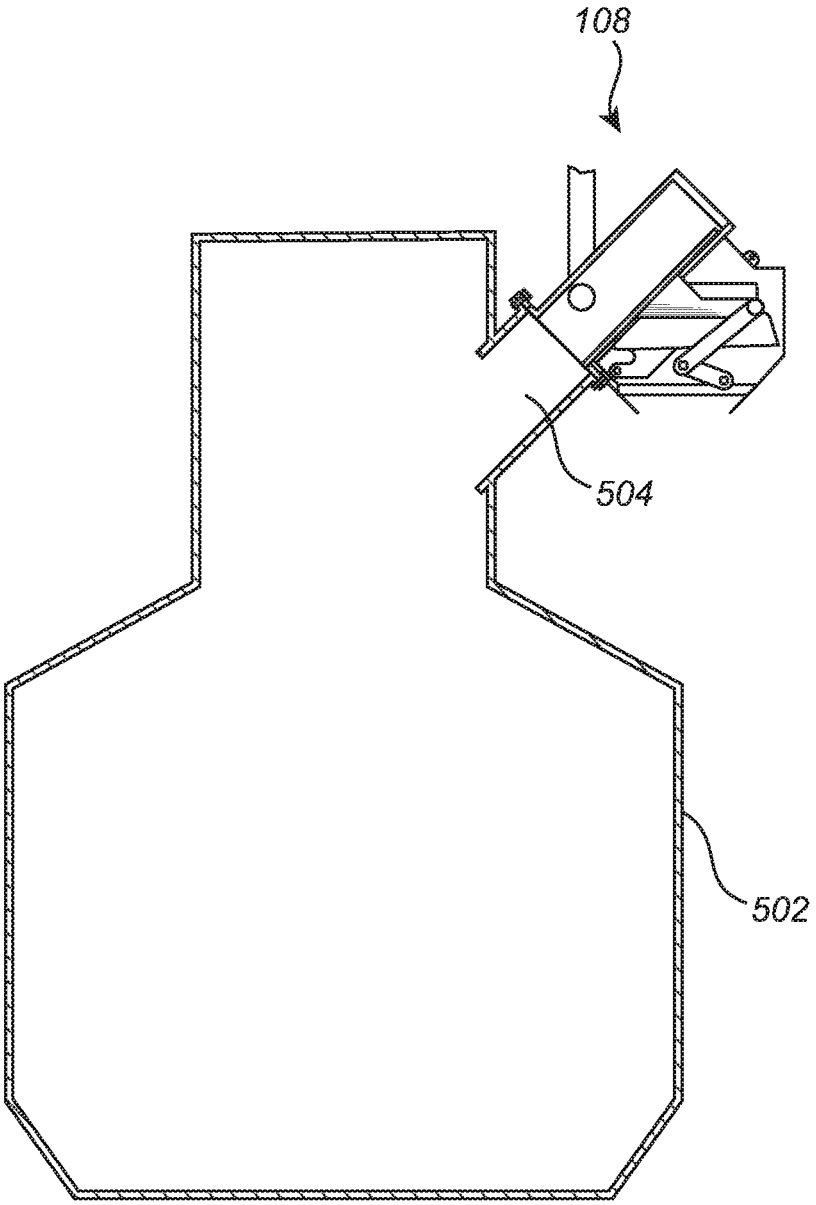

Turning finally to FIG. 5, conceptually illustrates a destruction system comprising a loading arrangement 108 and a chamber 502 arranged in a static upright position. Accordingly, in FIG. 5 the chamber 502 differs from the rotatable kiln 108 as shown above in that the chamber 502 is non-rotatable; typically arranged in a "stand still" upright position. Such an implementation may be specifically usable in relation to an, in comparison to the above discussed kiln 108, larger chamber. Such a larger chamber 502 may be applicable in relation to a more permanent destruction site where the destruction system is provided.

Similarly to the above discussion, the chamber 502 is provided with an input duct 504 connecting to the loading arrangement 108. The input duct 502 is typically provided with a similar flange as discussed above for secure connection to the loading arrangement, however as the chamber 502 is statically positioned, it may not be necessary to have a releasable connection to the loading arrangement 108 using the clamp 210. Instead, the connection may be of a more permanent type, for example connected by welding or using fasteners.

In summary, the present invention relates to a loading arrangement for a destruction system, the destruction system comprising at least one of a kiln or a detonation chamber configured for destruction of munitions, wherein the loading arrangement comprises an elongated transportation duct at one end comprising an open engagement portion adapted to provide a connection to an input duct of the at least one of the kiln or the detonation chamber, a cradle being hinged to the transportation duct at a cradle opening of the elongated transportation duct, and a fragment valve connected to the cradle, wherein the elongated transportation duct is arranged at a positive angle in relation to a horizontal plane, the cradle in a first position is configured to receive the munitions, the cradle in a second position is at least partly inserted into the elongated transportation duct through the cradle opening allowing the munition to slide into the at least one of the kiln or the detonation chamber, and the cradle in the first position is configured to adjust a position of the fragment valve for closing the cradle opening of the transportation duct.

Advantages with the invention include an improved safety situation surrounding loading of munitions into a chamber of the destruction system.

The control functionality of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show a sequence the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps. Additionally, even though the invention has been described with reference to specific exemplifying embodiments thereof, many different alterations, modifications and the like will become apparent for those skilled in the art.

Variations to the disclosed embodiments can be understood and effected by the skilled addressee in practicing the claimed invention, from a study of the drawings, the disclosure, and the appended claims. For example, the kiln may have other shapes than illustrated in the drawings, it should also be understood that the word "munitions" includes any explosive or similar material appropriate for the destruction system. In the description a feeding box is mentioned to hold the munitions. The invention is equally applicable without the feeding box, in other words, the munitions may be loaded directly in the loading tray without the feeding box. That is, the word "feeding box" may be replaced by "munitions". Furthermore, in the claims, the word "comprising" does not exclude other elements or steps, and the indefinite article "a" or "an" does not exclude a plurality.

I claim:

1. A loading arrangement for a destruction system, the destruction system comprising at least one of a kiln or a detonation chamber configured for destruction of munitions, wherein the loading arrangement comprises:

an elongated transportation duct at one end comprising an open engagement portion adapted to provide a connection to an input duct of the at least one of the kiln or the detonation chamber, a cradle being hinged to the transportation duct at a cradle opening of the elongated transportation duct, the cradle configured to allow for a transition from a first to a second position, and a fragment valve mechanically connected to the cradle by linking elements, wherein the elongated transportation duct is arranged at a positive angle in relation to a horizontal plane, the cradle in the first position is configured to receive the munitions, the linking elements closing the fragment valve, thereby closing the cradle opening of the elongated transportation duct, the cradle in the first position positioned outside of the elongated transportation duct, and the cradle in the second position is configured to be at least partly inserted into the elongated transportation duct through the cradle opening, the fragment valve pushed into the elongated transportation duct by the linking elements, allowing the munition to slide into the at least one of the kiln or the detonation chamber.

2. The loading arrangement according to claim 1, wherein the hinge of the cradle is arranged in the vicinity of the open engagement portion of the elongated transportation duct, thereby allowing the cradle to be tilted into the elongated transportation duct.

3. The loading arrangement according to claim 1, wherein the cradle is essentially horizontally arranged when in the first position.

4. The loading arrangement according to claim 1, wherein the open engagement portion of the elongated transportation duct is configured to be releasably connected to the input duct of the at least one of the kiln or the detonation chamber.

5. The loading arrangement according to claim 4, further comprising locking means for securely connecting the loading arrangement to the at least one of the kiln or the detonation chamber.

6. The loading arrangement according to claim 5, wherein the locking means comprises a releasable clamp, the clamp configured to engage with a flange provided at the input duct of the at least one of the kiln or the detonation chamber.

7. The loading arrangement according to claim 1, further comprising actuators arranged to transition the cradle from the first to the second position.

8. A destruction system, comprising:

at least one of a kiln or a detonation chamber configured for destruction of munitions, said at least one of a kiln or a detonation chamber comprising an input duct, and a loading arrangement according to claim 1, the loading arrangement connected to the input duct of the at least one of a kiln or a detonation chamber.

9. The destruction system according to claim 8, wherein the kiln comprises an electrical heating element.

10. The destruction system according to claim 8, wherein the kiln is configured to be rotatable about a horizontal axis between a first loading and operating position and in a second emptying position, and the kiln when arranged in the first loading and operating position is configured to releasably connect to the loading arrangement.

11. The destruction system according to claim 8, wherein the kiln is rotated about the horizontal axis from the first position to the second position in a direction such that the input duct travels past a vertical axis of the kiln, a rotating angle being at least 120°.

12. The destruction system according to claim 10, wherein the input duct is arranged at an upper portion of the kiln and the electrical heating element is arranged at a lower portion of the kiln when the kiln is arranged in the first loading and operating position.

13. The destruction system according to claim 8, wherein the at least one of a kiln or a detonation chamber is arranged in a static upright position, the at least one of a kiln or a detonation chamber having the input duct arranged at its upper portion and further comprising an output duct arranged at its lower portion.

14. The destruction system according to claim 8, further comprising at least one of:

a camera for monitoring an amount of waste material in the kiln, the waste material relating to previously destructed munitions, and a control unit configured to controlling the transition of the cradle from the first to the second position.

* * * * *